US005897046A

United States Patent [19]

Oehri et al.

[11] Patent Number: 5,897,046

[45] Date of Patent: Apr. 27, 1999

[54] APPARATUS WITH MAGAZINE FOR DRIVING FASTENING ELEMENTS

[75] Inventors: Kurt Oehri, Schaan, Liechtenstein; Michael Maier, Rankweil, Austria

[73] Assignee: Hilti Aktiengesellschaft, Schaan, Liechtenstein

[21] Appl. No.: 09/028,529

[22] Filed: Feb. 24, 1998

[30] Foreign Application Priority Data

Feb. 24, 1997 [DE] Germany ..... 197 07 234

[51] Int. Cl.[6] ..... B25C 1/04; B25C 1/14; B25C 5/06

[52] U.S. Cl. ..... 227/119; 227/120; 227/136

[58] Field of Search ..... 227/119, 109, 227/120, 8, 130, 135, 136, 137

[56] References Cited

U.S. PATENT DOCUMENTS

| | | | |
|---|---|---|---|
| 3,491,932 | 1/1970 | Novak | 227/136 |
| 3,550,831 | 12/1970 | Obergfell | 227/136 |
| 3,650,453 | 3/1972 | Smith, Jr. | 227/136 |
| 4,463,888 | 8/1984 | Geist et al. | 227/119 |
| 4,930,673 | 6/1990 | Pfister | 227/120 |
| 5,065,930 | 11/1991 | Kennedy | 227/120 |
| 5,332,141 | 7/1994 | Mukoyama et al. | 227/136 |

*Primary Examiner*—Scott A. Smith
*Attorney, Agent, or Firm*—Anderson, Kill & Olick, P.C.

[57] ABSTRACT

Apparatus for driving fastening elements (9), such as nails, bolts, clips and the like, into a receiving material includes a magazine (3) extending laterally outwardly from a guide (1). The magazine (3) holds a carrying strip (10) for the fastening elements (9) and a transport slide (8) which, in cooperation with the magazine, can be shifted parallel to the driving direction of the apparatus. The magazine (3) has a housing (31) and a guide channel (37) opening into a transport channel (11) in the guide (1). The guide channel (37) is formed by two laterally spaced guide rails (5, 6) each with a surface facing the other and profiled with tooth-shaped projections having tooth flanks of different lengths with the flanks facing the transport channel (11) being shorter. A first guide rail (5) can be displaced away from a second guide rail (6) parallel to the length of the guide channel (37) by the transport slide (8). The transport slide (8) interacts with a control cam (53) located on the first guide rail (5). Both the first and second guide rails (5, 6) can be shifted laterally against the force of a spring (7).

10 Claims, 2 Drawing Sheets

APPARATUS WITH MAGAZINE FOR DRIVING FASTENING ELEMENTS

BACKGROUND OF THE INVENTION

The present invention is directed to an apparatus for driving fastening elements, such as nails, bolts, clips and the like, into a receiving material. The apparatus includes an apparatus housing with a guide extending in the driving direction and a transport channel in the guide for moving fastening elements from a magazine into the guide. The magazine contains a transport slide displaceable parallel to the driving direction. Further the magazine includes a magazine housing containing a guide channel extending transversely of the driving direction and open to a transport channel in the guide. The guide channel has a first guide rail and a second guide rail extending transversely of the driving direction of the apparatus and spaced laterally apart. Each guide rail has a surface facing the other with the facing surfaces profiled with tooth-shaped projections each having tooth flanks of different lengths. The first guide rail can be shifted by the transport slide laterally outwardly from the second guide rail against the force of a spring while it extends parallel to the guide channel. The transport slide interacts with a control cam-located on the first guide rail.

In U.S. Pat. No. 2,346,884 a device for driving fastening elements, in the form of nails, into a receiving material, includes a guide, a magazine and a transport slide. The magazine, which can be removed from the guide, has two guide rails each with a tooth-shaped profiled surface facing the other and with the tooth-shaped surfaces having tooth flanks of different lengths. The tooth flanks facing a transport channel in the guide are shorter than the other flanks. A first guide rail can be displaced laterally away from the other or second guide rail against the force of a spring. The second guide rail can be shifted axially and displaced laterally. During transport of the fastening elements located between the guide rails, the fastening elements are moved in the direction of the guide by the tooth-shaped profile of the first guide rail and are moved or rolled over the longer tooth flanks of the second guide rail until they reach a position again in the region of shorter flanks. In such position,. they are aligned in a plane extending through the axis of a driving piston.

With this known driving device, it is not possible to work with fastening elements spaced apart from one another by a basically deformation resistant carrying strip. If, for example, a portion of the carrying strip is located in the transport channel of the guide, the stiffness of the carrying strip counteracts a lateral shifting of the fastening elements, when fastening elements are moved over the longer tooth flanks, and there may be interference with the transporting step or damage to the carrying strip. There is a further disadvantage that the removal of the fastening elements located between the guide rails in the magazine can take place only when the magazine is separated from the guide and the fastening elements are pulled individually from the guide rails counter to the driving direction.

SUMMARY OF THE INVENTION

Therefore, the primary object of the present invention is to provide an apparatus for driving fastening elements including a magazine and a transport slide so that the fastening elements held by a carrying strip can be transported safely and simply, and where the carrying strip can be moved rapidly and easily opposite to the transporting direction in the magazine without the expenditure of force.

In accordance with the present invention, a second guide rail can be displaced or shifted laterally away from the first guide rail against the force of a spring. When fastening elements held by a carrying strip are moved, it is important that the fastening elements are aligned with a plane extending through the axis of a driving piston of the apparatus. This feature is achieved by the lateral displaceability of the second guide rail which can be displaced sideways essentially simultaneously with the first guide rail, when the first guide rail is shifted in the transport direction by the transport slide and the fastening elements are moved towards the guide.

When the first guide rail is shifted opposite to the transport direction, it is important that the fastening elements retain their position within the magazine and are not displaced by the tooth-shaped profiled surfaces of the first guide rail opposite to the transport direction, whereby the fastening elements are pressed against the profiled surface of the second guide rail. To keep the second guide rail from displacement sideways, preferably it is fixed from such displacement during the shifting of the first guide rail opposite to the transport direction.

Since the shifting or displacement of the first guide rail opposite to the transport direction takes place with the aid of a transport slide as a function of the pressing motion of the driving apparatus, it is advantageous for control reasons that the second guide rail is fixed laterally by the transport slide. Since fixing the second guide rail against lateral displacement is necessary only if the first guide rail is shifted by the transport slide opposite to the transport direction, it is advisable for the sake of an economic and simple manufacturing process that at least a part of the transport slide can be shifted in a free space formed between the second guide rail and a portion of the magazine housing, with the lateral extent of the free space corresponding essentially to the extent of the portion of the transport slide running parallel to the free space.

To save weight the transport slide is formed as a U-shaped shackle with two free ends, and it is preferable to shift one of the two free ends into the free space.

To shift the transport slide relative to the housing as a function of the pressing motion, it is advisable if it protrudes over the housing of the magazine counter to the driving direction and interacts with a stop region on a side of the driving apparatus facing in the driving direction.

For pushing the carrying strip with the fastening elements rapidly and simply into the magazine, the guide channel, formed by the first and second guide rails, is advantageously constructed to be open at the free end of the magazine.

Further, so that the carrying strip can be placed easily in the magazine, the guide channel formed by the first and second guide rail is advantageously arranged to be open in the end region opposite to the driving direction.

After the driving operation has been completed, the driving apparatus is lifted off the receiving material. At the same time, the housing of the driving apparatus and the magazine move apart and the transport slide, interacting with a stop region of the driving apparatus facing in the driving direction, is shifted counter to the driving direction with the aid of a spring part located, for example, at the magazine. For automatically shifting the first guide rail in the transport direction, the first guide rail preferably can be shifted opposite to the transport direction against the force of the spring element. This spring element may be disposed, for example, in the region of the free end of the magazine.

The carrying strip can be removed from the magazine along with the fastening elements opposite to the transport direction and without the use of force, if the tooth-shaped profiled surfaces of the two guide rails do not interact with the fastening elements whereby the fastening elements become freely displaceable to clear the profiled surfaces. An appropriate clear dimension between the profiled surfaces is achieved advantageously by means of a rotatable cam which displaces the two guide rails simultaneously away from one another with the amount of displacement of each guide rail corresponding at least to the height of the tooth-shaped profiled surfaces.

The movement of the fastening elements in the direction of the guide can take place not only over the fastening elements, but also, for example, over the carrying strips, in that the two guide rails interact with the carrying strip and the fastening elements or with the carrying strip.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described a preferred embodiment of the invention.

DETAILED DESCRIPTION OF THE INVENTION

Figure 1:
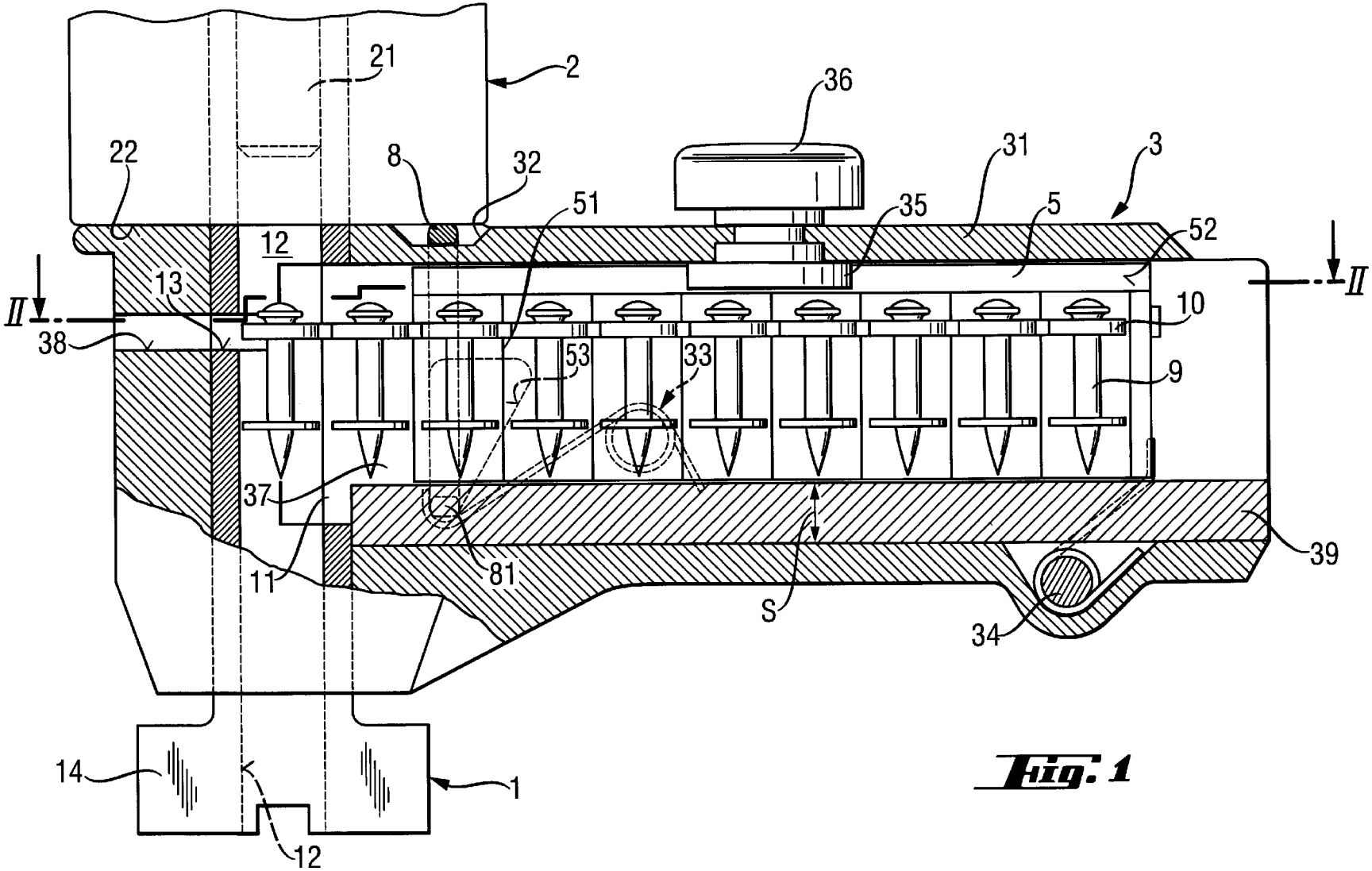
FIG. 1 is a side view of the magazine and a part of the driving apparatus, shown partly in section.
Figure 2:
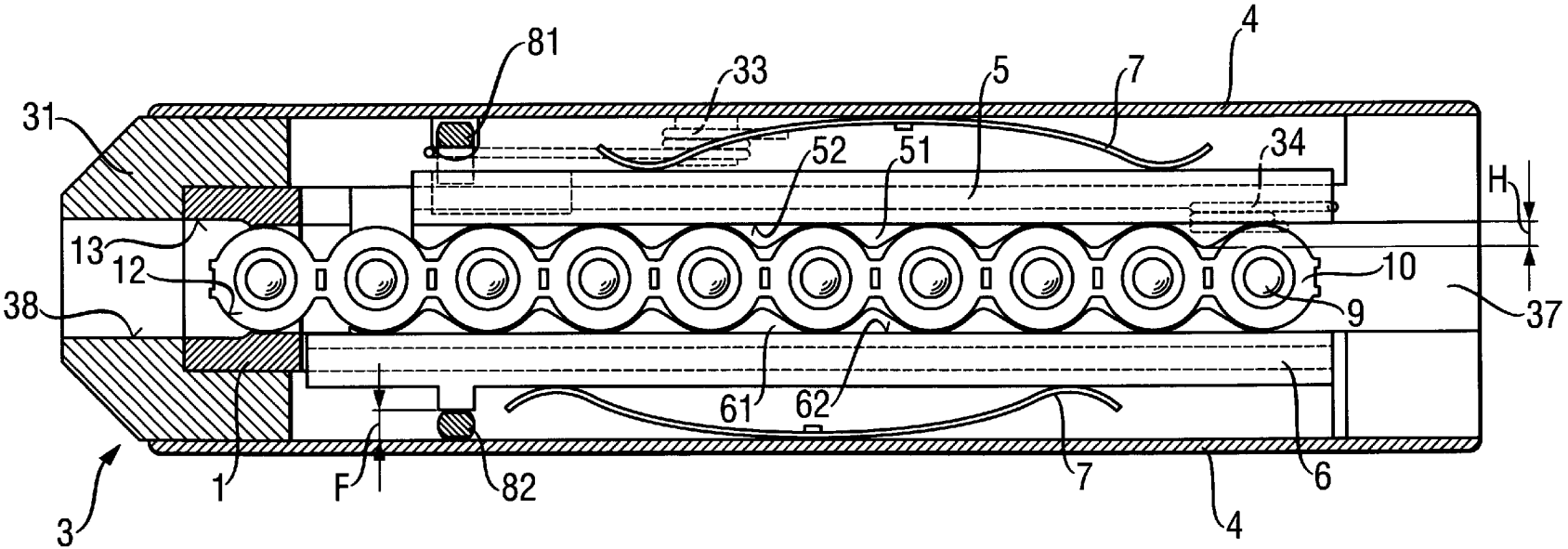
FIG. 2 is a sectional view taken along the line II—II in FIG. 1.

An apparatus for driving fastening elements 9, such as nails, bolts, clips and the like, into a receiving material is shown in FIGS. 1 and 2 and includes an apparatus housing 2 in which a driving piston 21 is shown in phantom and faces in a driving direction. A guide 1 extends downwardly from the lower end of the housing 2, as viewed in FIG. 1, so that it projects at least partly beyond the housing 2. A bed plate 14 is located at the lower or free end of the guide 1. Guide 1 has a central through bore 12 serving for partial guidance of the shaft of the driving piston 21 and also for holding a fastening element 9 in position before it is driven by the driving piston into the receiving material, not shown.

A magazine 3 is located between the lower end of the housing 2 and the bed plate 14 and is arranged to hold a carrying strip 10 for a number of fastening elements 9 spaced apart from one another in a transport direction in the magazine. The magazine 3 extends laterally outwardly from the guide 1 extending transversely of the driving direction. The magazine 3 has a pair of spaced covers 4 as shown in FIG. 2. The magazine 3 laterally encloses the guide 1 and has a guide channel 37 extending substantially perpendicularly to the driving direction and opens into a radially extending transport channel 11 in the guide 1. The carrying strip 10 with the fastening elements 9 is located within the guide channel 37.

The dimension of the transport channel 11 extending parallel to the driving direction, corresponds at least to the length of the fastening elements 9 to be driven in to the receiving material, not shown. The dimension of the transport channel 11 extending transversely of the driving direction, corresponds essentially to the largest diameter of the fastening elements 9.

On the side of the guide 1 opposite the transport channel 11, the guide 1 and the housing 31 of the magazine 3 each have a radially extending through hole 13, 38 arranged coaxially with one another. The cross-sectional area of the through holes 13, 38 is larger than the cross sectional area of the carrying strip 10. The carrying strip 10 can exit the central through bore 12 of the guide 1 through the holes 13, 38. If the carrying strip 10 is formed by individual guiding elements, not shown, which can be separated from one another and surround the fastening elements 9, the through holes 13, 38 are not required. Such individual guiding elements leave the central through bore 12 in the driving direction.

The guide channel 37 is open at the free end as well as in the end region of the magazine opposite to the driving direction. Within the guide channel 37 there are two elongated guide rails 5, 6 extending in the transport direction, which interact with the carrying strip 10. The two guide rails or the first guide rail 5 and the second guide rail 6 have profiled surfaces facing one another with the profiled surfaces having tooth shaped projections 51, 61 each with two flanks of different lengths. The two flanks of the first and second guide rails 5, 6 facing toward the transport channel 11 are shorter than the two flanks facing away from the transported channel 11, as can be seen in FIG. 2. The projections 51, 61 have a dimension H extending inwardly toward one another from the corresponding guide rails 5, 6.

The first guide rail 5 can be shifted or displaced by a transport slide 8 relative to the second guide rail 6 and parallel to the length of the guide channel 37. Both the first and second guide rails 5, 6 can be displaced laterally against the force of a spring 7, note FIG. 2.

The transport slide 8 positioned in the magazine 3, is a U-shaped shackle having a bight part protruding from the magazine so that it interacts with a stop region 22 on the lower end face of the housing 2 facing in the driving direction when the driving apparatus is pressed against a receiving material, not shown. The transport slide 8 can be arranged at least in part in a recess 32 on the upper surface of the magazine as viewed in FIG. 1.

The transport slide 8 has a first free end 81 and a second free end 82, note FIG. 2, and the first free end 81 interacts with a control cam 53 disposed on the outside of the first guide rail 5 for displacing the first guide rail counter to the transport direction.

Between the second guide rail 6 and the inside of the magazine housing 31, there is a free space F, note FIG. 2, into which the second free end 82 of the transport slide 8 projects. The second free end 82 prevents a lateral displacement of the second guide rail 6, when the first guide rail 5 is displaced opposite to the transport direction against the force of a spring element 34 by the first free end 81 of the transport slide. By such means, the displacement of the fastening elements, located between the first and second guide rails 5, 6 together with the carrying strip 10 opposite to the transport direction is prevented. When the first guide rail 5 is moved, only the first guide rail is shifted sideways. The lateral dimension of the second free end 82 of the transport slide 8 corresponds generally to the lateral dimension of the free space F.

When the driving apparatus is lifted off the receiving material, the transport slide 8 is moved by the spring part 33 opposite the driving direction. At the same time, the second free end 82 of the transport slide 8 is moved out of the free space F between the second guide rail 6 and the housing 31 of the magazine 3, so that the second guide rail can be displaced sideways. The first free end 81 of the transport slide 8 again releases the first guide rail 5 in the transport direction. The spring element 34, interacting with the first guide rail 5, pushes the first guide rail 5 in the transport direction. Since the two flanks of the profiled surfaces 51, 61 on the two guide rails 5, 6 facing the guide 1, are shorter than the two flanks facing in the opposite direction, the fastening elements located between the guide rails are moved in the transport direction. Because both guide rails 5, 6 can be shifted sideways against the force of the springs 7, the carrying strip 10 with the fastening elements 9 can be displaced in the direction of the transport channel 11 without effecting any lateral movement at all.

On the upper side of the magazine 3 as viewed in FIG. 1, that is, the side facing opposite to the driving direction, there is a rotary knob 36 connected to a cam 35 located in the magazine 3. The cam 35 extends between the first and second guide rails 5, 6 and can be rotated by the rotary knob 36. When the cam is rotated, a force, acting in the lateral direction, is directed against the facing surfaces 52, 62 of the guide rails 5, 6, whereby the guide rails are shifted essentially simultaneously by such an amount so that the fastening elements 9, located in the magazine 3 can be removed counter to the transport direction.

Within the housing 31 of the magazine 3, on the lower side as viewed in FIG. 1, there is a replaceable guide strip 39 having a thickness S, the guide strip aids in maintaining the carrying strip 10 so that its cross section is aligned coaxially with the two holes 13, 38 of the guide 1 and the magazine 3. If the fastening element 9 has a greater length, then the thickness S of the guiding strip 39 is correspondingly small, and if the fastening elements are relatively short, then the thickness S of the guiding strips is correspondingly large.

While specific embodiments of the invention have been shown and described in detail to illustrate the inventive principles, it will be understood that the invention may be embodied otherwise without departing from such principles.

We claim:

1. Apparatus for driving fastening elements (9), such as nails, bolts, clips and the like, in a driving direction into a receiving material, comprises a guide (1) extending in the driving direction, a transport channel (11) in said guide (1) and extending at least through said guide substantially perpendicularly to the driving direction, a magazine (3) for the fastening elements (9) extends outwardly from said guide (1) transversely of the driving direction, a transport slide (8) displaceable against said magazine (3) parallel to the driving direction, said magazine (3) comprises a housing (31) enclosing a guide channel (37) extending transversely of the driving direction and opening to said transport channel (11), said guide channel (37) comprises a first guide rail (5) and a second guide rail (6) extending transversely of the driving direction and spaced laterally apart, said first and second guide rails (5, 6) each having a surface facing the other, said surfaces being profiled with tooth-shaped projections each having two flanks of different lengths in the direction extending transversely of the driving direction with a first tooth flank facing said transport channel being shorter than a second tooth flank facing in the opposite direction, said first guide rail (5) being shiftable by said fastening elements (9) laterally outwardly away from second guide rail against the force of a spring (7) and parallel to said guide channel (37) by said transport slide (8), said transport slide (8) interacts with a control cam (53) disposed on said first guide rail (5), and said second guide rail (6) being shiftable laterally away from said first guide rail against a force of at least one other spring (7).

2. Apparatus, as set forth in claim 1, wherein means are arranged to fix said second guide rail (6) against lateral movement.

3. Apparatus, as set forth in claim 2, wherein said means for fixing said second guide rail (6) against lateral movement comprises said transport slide (8).

4. Apparatus, as set forth in claim 3, wherein a free space (F) is formed by said second guide rail (6) and a portion of said housing (31), at least a portion of said transport slide (8) can be shifted into said free space (F), lateral dimension of the free space (F) corresponds essentially to the lateral extent of said transport slide (8) extending parallel therewith.

5. Apparatus, as set forth in claim 4, wherein said transport slide (8) is a U-shaped shackle, and a free end of said shackle can be shifted into said free space (F).

6. Apparatus, as set forth in one of claims 1 to 5, wherein said transport slide (8) projects over a surface of said housing (31) of said magazine (3) facing opposite to the driving direction and interacts with a stop surface (22) of a surface of said driving apparatus facing in the driving direction.

7. Apparatus, as set forth in one of claims 1 to 5, wherein said guide channel (37) formed by said first guide rail (5) and said second guide rail (6) is open at a free end of the magazine (3).

8. Apparatus, as set forth in one of claims 1 to 5, wherein said guide channel (37) formed by said first guide rail (5) and second guide rail (6) is open in an end region facing opposite to the driving direction.

9. Apparatus, as set forth in one of claims 1 to 5, wherein said first guide rail (5) can be displaced opposite to the transport direction against a force of a spring element (34).

10. Apparatus, as set forth in one of claims 1 to 5, wherein said first and second guide rail (5, 6) can be essentially simultaneously displaced laterally away from one another by a rotatable cam (35) located in said magazine, and the amount of lateral displacement of said first and second guide rails (5, 6) corresponds at least to a dimension (H) of the tooth-shaped projection (51, 61) inwardly of the facing surfaces of said first and second guide rails.

* * * * *